US006938302B2

(12) United States Patent
Lin

(10) Patent No.: US 6,938,302 B2
(45) Date of Patent: Sep. 6, 2005

(54) DOOR CLOSING MECHANISM

(76) Inventor: Kun Long Lin, P.O. Box 590, Taichung City 406 (TW)

( * ) Notice: Subject to any disclaimer, the term of this patent is extended or adjusted under 35 U.S.C. 154(b) by 0 days.

(21) Appl. No.: 09/854,447

(22) Filed: May 14, 2001

(65) Prior Publication Data

US 2002/0184733 A1 Dec. 12, 2002

(51) Int. Cl.[7] ..... E05F 1/08
(52) U.S. Cl. ..... 16/72; 16/74; 16/86 B; 16/85; 16/86 A
(58) Field of Search ..... 16/72, 74, 85–86 C

(56) References Cited

U.S. PATENT DOCUMENTS

| | | | | | |
|---|---|---|---|---|---|
| 2,953,811 | A | * | 9/1960 | Hall | 16/66 |
| 4,776,440 | A | * | 10/1988 | Yamada et al. | 16/66 |
| 4,875,252 | A | * | 10/1989 | Falconer et al. | 16/288 |
| 4,920,609 | A | * | 5/1990 | Lin | 16/66 |
| 5,517,719 | A | * | 5/1996 | Christ | 16/49 |
| 5,727,286 | A | * | 3/1998 | Shen | 16/49 |
| 6,317,922 | B1 | * | 11/2001 | Kondratuk | 16/49 |

* cited by examiner

*Primary Examiner*—Thomas B. Will
*Assistant Examiner*—Tara L. Mayo

(57) ABSTRACT

A door closing mechanism, involving a shaft rod that moves in relation to, and is installed inside a tube unit. On the shaft rod is an open/close unit.

1 Claim, 6 Drawing Sheets

DOOR CLOSING MECHANISM

BACKGROUND OF THE INVENTION

1. Field of the Invention

Conventional hinged doors swing open on hinges to accomplish closing and opening performances. To keep the door in place instead of closing after the door is opened, and to avoid powerful slamming when the door is closed automatically, it is a common practice to install a door closer for positioning and buffer effects.

2. Background of the Invention

A hinged door usually swings open or close on a hinge. To enable the door to fix in position without closing again by itself, and avoid powerful slamming, after the door is opened, the door body is generally installed with a door closer with positioning and buffer performances.

A regular door closer involves a tube unit in which is installed a shaft rod that moves in and out in relation to the tube unit. On the part of the shaft rod extending out of the tube unit is a positioning plate. The positioning plate matches an outside end of the tube unit, and can move on the rod unit. When the door is opened, the positioning plate stops between the shaft rod and one end of the tube unit, so the shaft rod could not automatically retract inside the tube unit, so that when the door is opened, the door can be positioned instead of closing on its own. To close the door, the stop plate must be moved or turned to disengage the stop function formed by the positioning plate on the shaft rod and the tube unit, so the door can be close automatically.

It is obvious that, however, when the door is to be positioned after the door is opened, the positioning plate must be adjusted, which could be inconvenient. Besides, the positioning plate can easily be dislocated from its original position by accidental impact, causing the door to close unexpectedly. Such inconveniences need improvement.

BRIEF DESCRIPTION OF THE INVENTION

This invention of door closing mechanism utilizes a catch mechanism installed inside a tube unit to control automatic door positioning and closing operations without manual control, thereby to enable more convenient operation and avoid accidental activation by mistake.

To achieve that objective, this invention involves a shaft rod installed inside a tube unit, an open/close unit on the shaft rod, and a catch unit inside the tube unit, which interact to the open/close unit on the shaft rod to produce engagement and positioning performance on the shaft rod, or cause the shaft rod to automatically retract to the inside of the tube unit. The open/close unit involves a positioning block that is fixed on the shaft rod, a slide block that can move relatively to the shaft rod, and a spring installed between the positioning block and the slide block. The open/close unit involves a positioning block that is installed on the shaft rod, a slide block that can move in relation to the shaft rod, and a fixed block on the shaft rod to match one end of the slide block. The catch unit involves a catch hook that is hinged to the inside of the tube unit, or a cone sleeve with a catch part installed inside the tube unit.

BRIEF DESCRIPTION OF DRAWINGS

The drawings of preferred embodiments of this invention are described in following details to enable better understanding.

BRIEF DESCRIPTION OF NUMERALS

| | | |
|---|---|---|
| 11 tube unit | 12 accommodating chamber | 21 shaft rod |
| 22 stop plate | 23 resetting spring | 31 open/close unit |
| 32 positioning block | 33 slide block | 34 spring |
| 35 incline | 36 incline | 37 compressed space |
| 41 catch unit | 42 seat block | 43 catch unit |
| 44 through hole | 45 mounting hole | 46 joining hole |
| 47 insert groove | 48 elastic plate | 49 pressing part |
| 51 shaft hole | 52 catch part | 53 arched outside edge |
| 54 hinge shaft | 55 insert groove | 61 positioning block |
| 62 slide block | 63 stop block | 64 incline |
| 65 catch hole | 66 cone part | 67 incline |
| 68 arched end edge | 71 seat block | 72 catch unit |
| 73 through hole | 74 catch plate | 75 catch part |

DETAILED DESCRIPTION OF PREFERRED EMBODIMENTS

Figure 1:
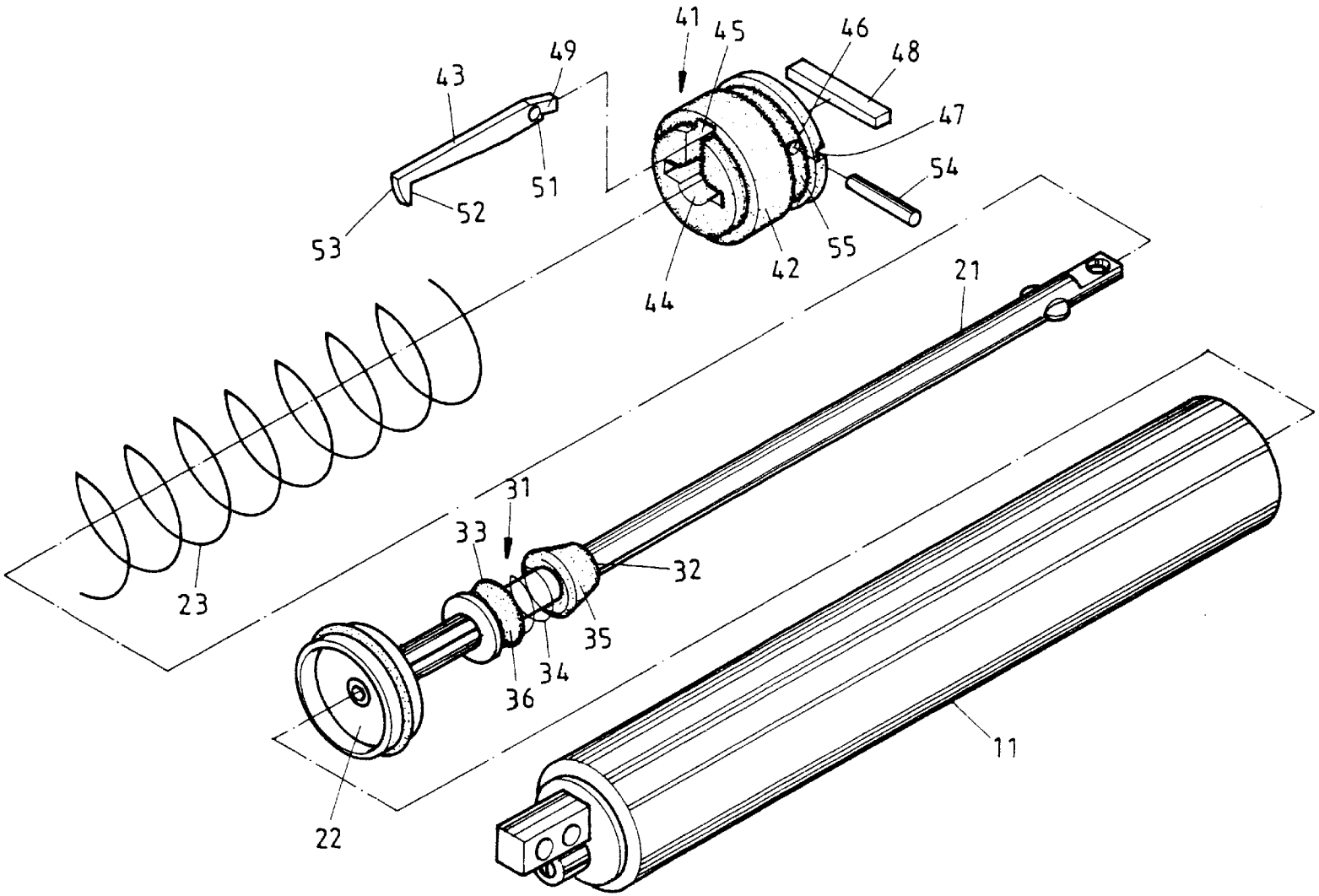
FIG. 1 is an exploded view of the invention.
Figure 2:
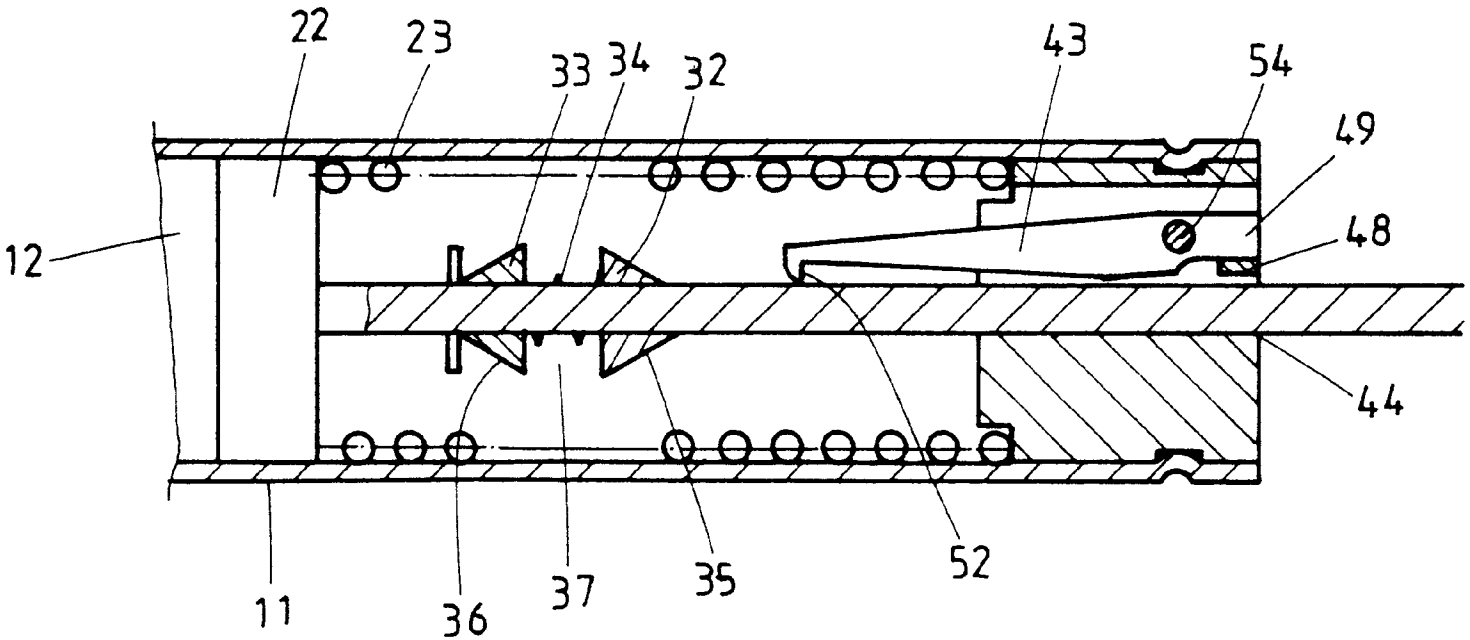
FIG. 2 is a schematic view of the invention.

As shown in FIGS. 1 and 2, this invention comprises a tube unit 11, a shaft rod 21, an open/close unit 31 and a catch unit 41. The tube nit 11 is axially hollow to form an accommodating chamber 12. The shaft rod 21 has a stop plate 22 at one end, and the shaft rod 21 inserted in a resetting spring 23 that in turn is accommodated in the accommodating chamber 12 of the tube unit 11, so positioned that one end of the resetting spring 23 presses against the surface of the stop plate 22. The open/close unit 31 is composed of a positioning block 32, a slide block 33 and a spring 34. The positioning block 32 is shaped as a cone having one end with a larger outer diameter, another end with a smaller outer diameter, an exterior surface shaped as an incline 35, and is fixed onto the shaft rod 21. Alternatively, the positioning block 32 is mono-bloc formed directly with the shaft rod 21 and protruded from the surface of the shaft rod 21, having a larger outside diameter at one end of the positioning block 32 and a smaller outside diameter at the other end of the positioning block 32, forming an incline 35 on the exterior of the positioning block 32. The slide block 33 is shaped like a cone, having a larger outside diameter at one end and a smaller outside diameter at the other end, and an incline 36 on the exterior, the slide block 33 movably mounted onto the shaft rod 21, its end with a larger outside diameter positioned correspondingly at the end of larger diameter of the positioning block 32. The spring is located on the shaft rod 21 between the positioning block 32 and the slide block 33, the positioning block 32 and the slide block 33 being spaced from each other at a distance to form a compressed space 37. The catch unit 41 is composed of a seat block 42 and a catch unit 43. The seat block 42 has a through hole 44 on the shaft, on one side of said through hole 44 is a mounting hole 45, the through hole 44 and the mounting hole 45 connecting to each other. On the seat block 42 is a joining hole 46 that is connected to the mounting hole 45. On the surface of one end of the seat block 42 is an insert groove 47. The insert groove 47 has an elastic plate 48 embedded in it. One end of the catch unit 43 is formed as a pressing part 49. Next to the pressing part 49 is a shaft hole 51. The other end of the catch unit 43 is formed as a catch part 52, the outside edge of the catch part 52 forming an arched outside edge 53. The pressing part 49 of the catch unit 43 is inserted in the mounting hole 45 of the seat block 42, so the pressing part 49 is located on one side of the elastic plate 48, and a hinge shaft 54 is pressed through the through hole 44 and the shaft hole 51 to position the catch unit 43, 50 the hinge shaft 54 serves as a hinge. The whole unit composed of the seat block 42 and the catch unit 43 is installed at one end of a tube unit 1. One end of the shaft rod 21 slightly exposed from the through hole 44 of the seat block 42. The end of the shaft rod 21 exposed out of the tube unit 11 is connected to a door body The assembly of the seat block 42 and the catch unit 43 can be fixed and joined to the tube unit 11. On the outside of the seat block 42 is an insert groove 55. When the seat block 42 is assembled to one end of the tube unit 11, the tip of one end of the tube unit 11 can be folded and embedded inside the insert groove 55 of the seat block 42, to compose a robust joint.

Figure 3:
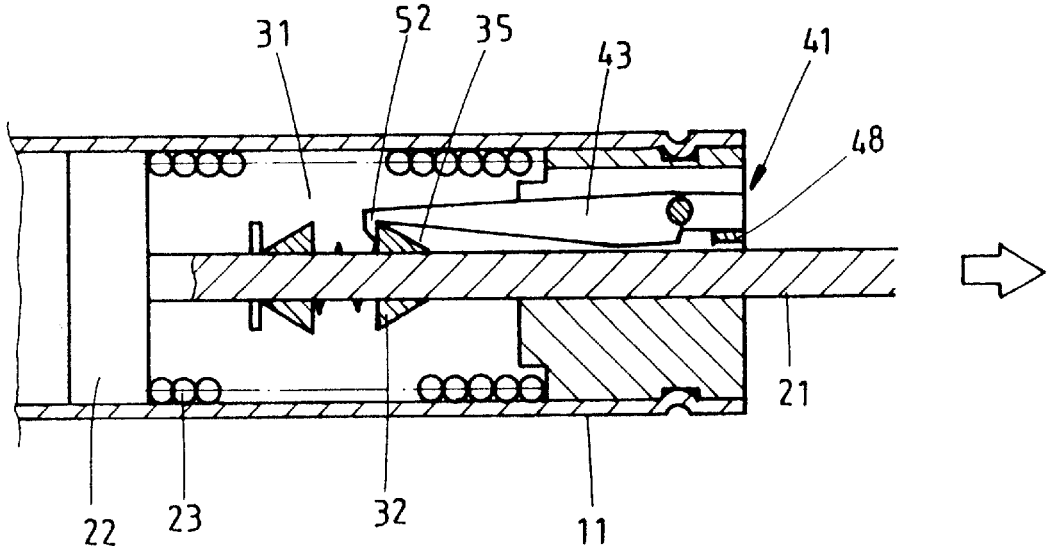
FIG. 3 is a schematic view of the invention in operation.

As shown in FIG. 3, the shaft rod 21 is extended out of the tube unit 11 when the door is opened. The positioning block 32 of the open/close unit 31 is brought in contact with the catch part 52 of the catch unit 43, the catch part 52 moves up along the incline 35 on the outside of the positioning block 32. When the catch part 52 travels past the end with a larger diameter of the positioning block 32, the resiliency of the elastic plate 48 forces the catch part 52 to move down and catch onto the face of the end with the larger diameter of the positioning block 32. Thus, the resetting spring 23 produces a compressed force to push the stop plate 22, but the shaft rod 21 will not be pulled back automatically because of the interacting forces of the catch unit 43 of the catch unit 41 and the positioning block 32 of the open/close unit 31.

Figure 4:
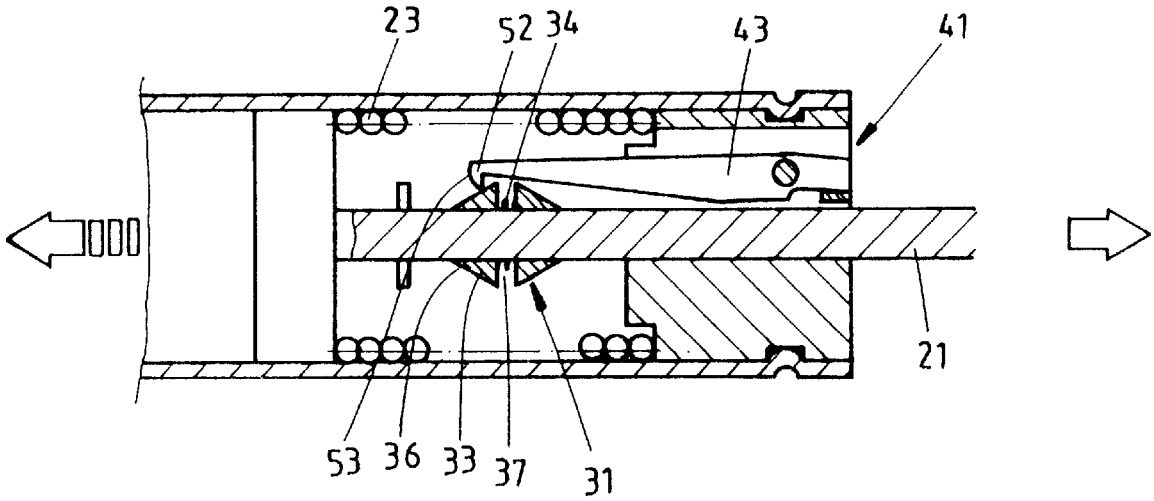
FIG. 4 is another schematic view of the invention in operation.

As shown in FIG. 4, when the door is closed, the door can be pushed out. The slide block 33 is brought in contact with the catch part 52 of the catch unit 43. Since the outer edge of the catch part 52 is formed as an arched outside edge 53, the catch part 52 can move across the end with a larger diameter of the catch part 52, so the catch part 52 is in contact with the outside incline 36 of the slide block 33, without engaging each other. Then, the compressed space between the positioning block 32 and the slide block 33 is shortened, so the spring 34 is compressed. When the door-pushing force is discontinued, since there is no engagement between the catch unit 43 of the catch unit 41 and the slide block 33 of the open/close unit 31, the shaft rod 21 will retract back to the inside of the tube unit 11 (in the direction shown by the dotted line) with the pushing of the resetting spring 23. At this time, the slide block 33 of the open/close unit 31 and the positioning block 32 engage each other quickly and move relatively. Since catch part 52 of the catch unit 43 and the incline 35 on the outside of the positioning block 32 are merely in contact without engagement, the shaft rod 21 is capable of performing automatic door-closing operation by moving the door unit.

Figure 5:
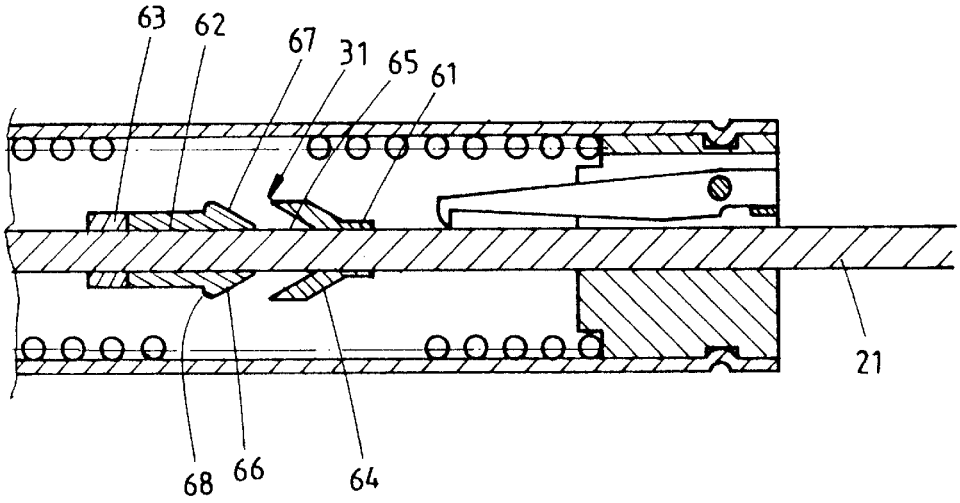
FIG. 5 is a schematic view of another preferred embodiment of the invention.

As shown in FIG. 5, the open/close unit 31 is composed of a positioning block 61, a slide block 62 and a stop block 63. The positioning block 61 has a larger outer diameter at one end and a smaller outer diameter at the other end, its surface formed as an incline 64, the larger end having a catch hole 65, the positioning block 61 fixed onto the shaft rod 21. One end of the slide block 66 is shaped as a cone 66 having gradually tapered outside diameter, the outside of the cone 66 forming an incline 67, the larger end of the cone 66 shaped to have an arched end edge 68. So designed that the slide block 62 is movably mounted on the shaft rod 21, the cone 66 matching the one larger end of the positioning block 61. The stop block 63 is fixed on the shaft rod 31 to match the slide block 62.

Figure 6:
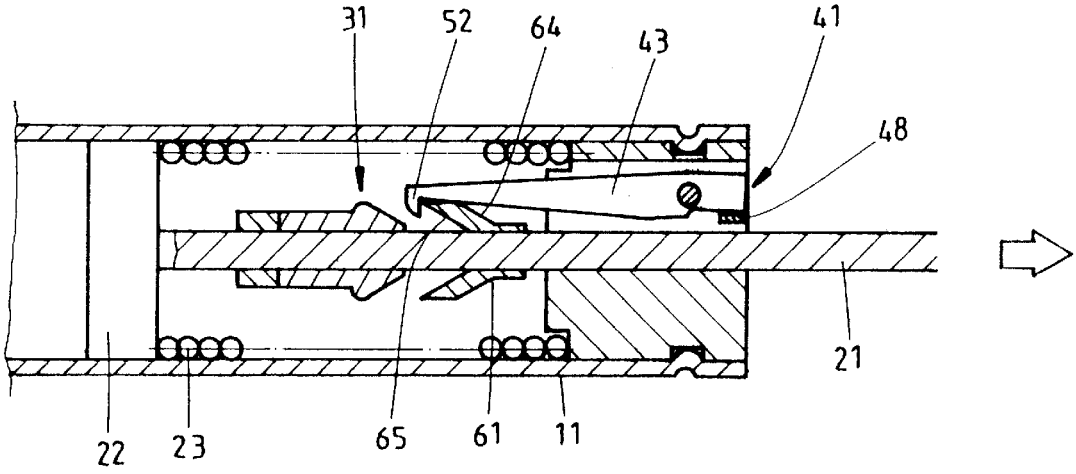
FIG. 6 is a schematic view of another preferred embodiment of the invention in operation.

As shown in FIG. 6, the shaft rod 21 is extended out of the tube unit 11 when the door is open. At this time, the positioning block 61 of the open/close unit 31 is in contact first with the catch part 52 of the catch unit 43, the catch part 52 moves up along the incline 64 on the outside of the positioning block 61. When the catch part 52 moves past the larger end of the positioning block 61, the resiliency of the elastic plate 48 will force the catch part 52 to move down to catch onto the catch hole 65 on the face of the larger end of the positioning block 61. Therefore, though the resetting spring 23 has a compressed force to push the stop plate 22, the shaft rod 21 will not be pulled back automatically, because of the interactive forces of the catch unit 43 of the catch unit 41 and the positioning block 61 of the open/close unit 31.

Figure 7:
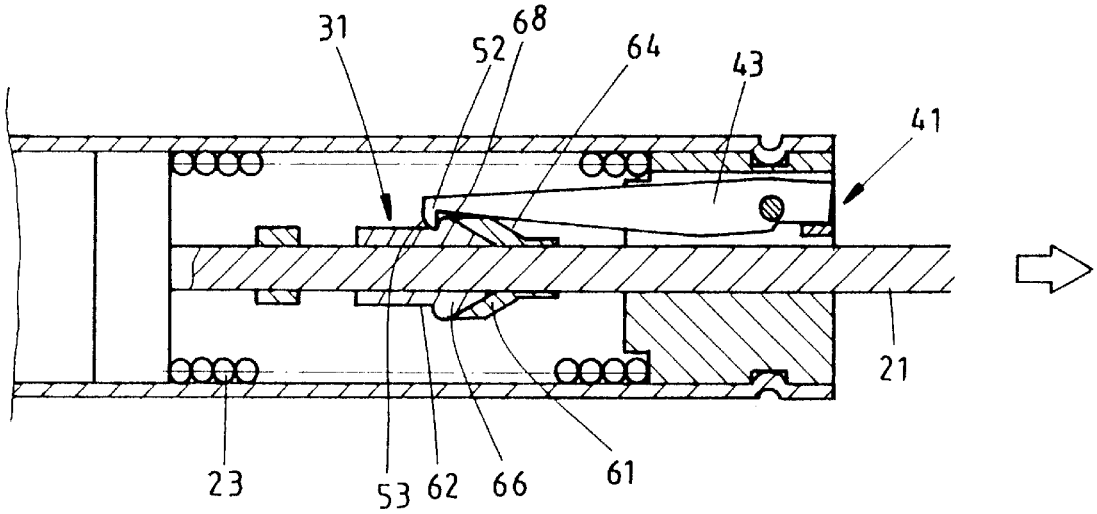
FIG. 7 is another schematic view of another preferred embodiment of the invention in operation.

As shown in FIG. 7, the door can be pushed out and opened when the door is closed. At this time, the slide block 62 is in contact with the catch part 52 of the catch unit 43. Because of the arched outside edge 53 formed on the outside of the catch part 52, the catch part 52 can travel across the larger end of the cone 66 of the slide block 62, so the catch part 52 hooks onto the arched end edge 68 of the slide block, and the cone 66 and the positioning block 61 are coupled. After the door-pushing force is discontinued, the catch part 52 and the arched end edge 68 are in contact between the catch unit 43 of the catch unit 41 and the slide block 62 of the open/close unit 31, so when pushed by the resetting spring 23, the catch part 52 will travel across the arched end edge 68 and rest on the incline 64 on the outside of the positioning block 61, causing the shaft rod 21 to retract to the inside of the tube unit 11, so the shaft rod 21 will drive the door to accomplish automatic door closing operation.

Figure 8:
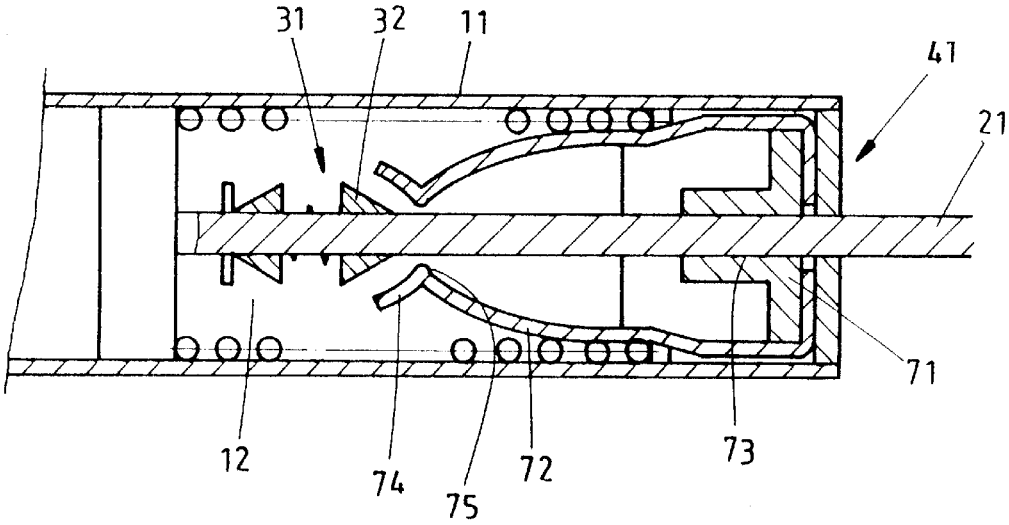
FIG. 8 is a schematic view of a third preferred embodiment of the invention.

As shown in FIG. 8, the catch unit 41 is composed of a seat block 71 and a catch unit 72 fitted to its end. On the shaft of the seat block 71 is a through hole 73. One end of the catch unit 72 is formed as an elastic catch plate 74. On the inside wall of the elastic catch plate 74 is a catch part 75. So designed that the assembly of the seat block 71 and the catch unit 72 is assembled to one end of the tube unit 11. The catch unit 72 is accommodated inside the accommodating chamber 12 of the tube unit 11, the shaft rod 21 penetrating the catch unit 72 and the through hole 73, and extending out of one end of the tube unit 11, while the catch plate 74 formed at one end of the catch unit 72 corresponding to the positioning block 32 of the open/close unit 31.

Figure 9:
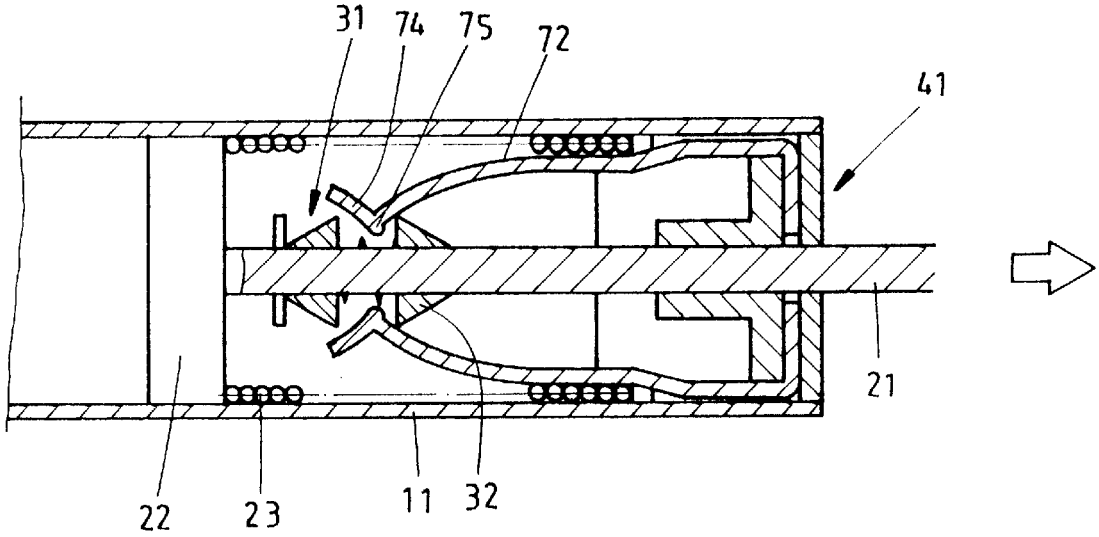
FIG. 9 is a schematic view of the third preferred embodiment of the invention in operation.

As shown in FIG. 9, when the door is opened, the shaft rod 21 is extended out of the tube unit 11. At this time, the positioning block 32 of the open/close unit 31 is extended into the catch unit 72, causing the positioning block 32 to run across the catch part 75, the larger end of the positioning block 32 and the catch part 75 are now engaged, and the shaft rod 21 is positioned in place. Thus, though the resetting spring 23 has a compressed force to push the stop plate 22, the shaft rod 21 will not be pulled back automatically, because of the interactive forces of the catch plate 74 of the catch unit 41 and the positioning block 32 of the open/close unit 31.

Figure 10:
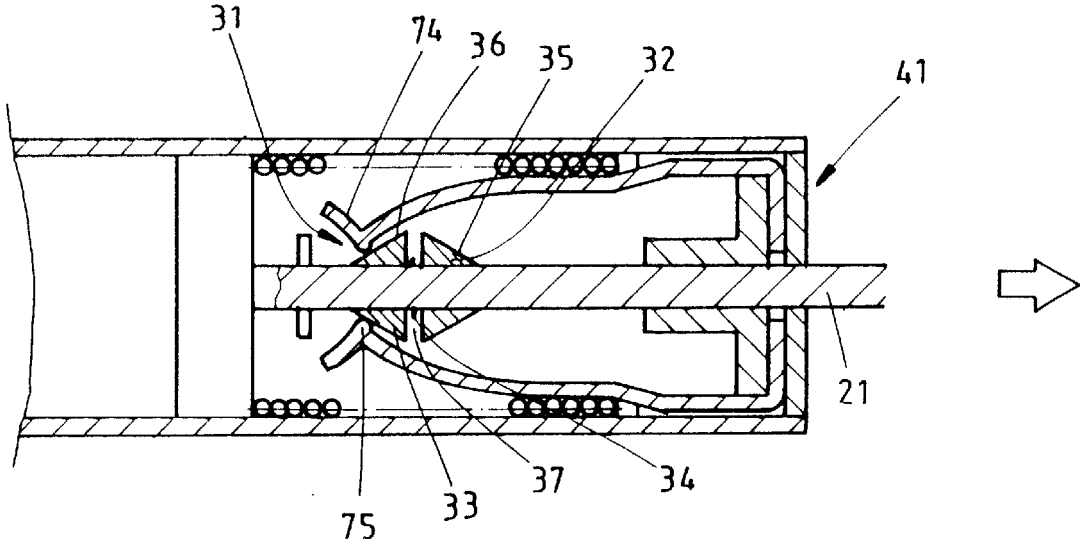
FIG. 10 is another schematic view of the third preferred embodiment of the invention in operation.

As shown in FIG. 10, the door can be pushed out and opened when it is closed. At this time, due to the elastic expansion force of the catch plate 74 and the arch surface of the catch part 75, the larger end of the slide block 33 can travel pass the catch part 75. There is no engagement between the part 75 and the incline 36 on the outside of the slide block 33, because they are merely in contact. The compressed space 37 is shortened between the positioning block 32 and the slide block 33, compressing the spring 34. When the door pushing force is discontinued, since there is no engagement between the catch plate 74 of the catch unit 41 and the slide block 33 of the open/close unit 31, the shaft rod 21 will retract to the inside of the tube unit 11 with the pushing of the resetting spring 23. At this time, the slide block 33 and the positioning block 32 of the open/close unit 31 quickly move in relation to the catch plate 74. And, since there is no engagement between the catch plate 74 of the catch unit 72 and the incline 35 on the outside of the positioning block 32, because they are merely in contact, the shaft rod 21 is able to drive the door body to accomplish closing operation.

As described above, this invention is capable of allowing the door to be pushed to a predefined position and stay there. When the door pushed again by a slight force, it will close automatically. Therefore, this invention has an inventive step and more simplified feature than conventional models that use a stopper to stop relative movement of a shaft rod and a tube unit. Besides, the catch unit 41 and the open/close unit 31 of the invention are installed inside the tube unit 11, so they will not easily be touched off to close the door by mistake, which is quite practical.

The above disclosure covering merely the preferred embodiment and design drawings of the invention shall not be based to restrict or limit the subject claim. All equivalent skills or approaches, or applications deriving from the subject claim shall be included in the spirit and intent of the subject invention and claim.

What is claimed is:

1. A door closing mechanism comprising:

a tube unit having an axially aligned accommodating chamber;

a shaft rod installed along with a resetting spring inside the accommodating chamber of the tube unit, one end extended out of the tube unit;

an open/close unit comprising a positioning block, a slide block and a spring, wherein the positioning block is fixed onto the shaft rod, and the slide block is mounted on the shaft rod to match the positioning block, the spring is mounted between the positioning block and the slide block; and a catch unit comprising at least one catch unit, one end of the catch unit having a catch part, the other end of the catch unit being a shaft to the catch part, the catch unit being installed inside the accommodating chamber of the tube unit, and interacting with the open/close unit, enabling the shaft rod to fit in position and move automatically.

* * * * *